US008524015B2

(12) United States Patent
Zhao et al.

(10) Patent No.: US 8,524,015 B2
(45) **Date of Patent: *Sep. 3, 2013**

(54) ALUMINUM ALLOY SHEET EXCELLENT IN RESISTANCE TO SOFTENING BY BAKING

(75) Inventors: Pizhi Zhao, Shizuoka (JP); Masaru Shinohara, Shizuoka (JP)

(73) Assignee: Nippon Light Metal Company, Ltd., Tokyo (JP)

( * ) Notice: Subject to any disclaimer, the term of this patent is extended or adjusted under 35 U.S.C. 154(b) by 381 days.

This patent is subject to a terminal disclaimer.

(21) Appl. No.: 10/572,202

(22) PCT Filed: Dec. 19, 2003

(86) PCT No.: PCT/JP03/01644

§ 371 (c)(1),
(2), (4) Date: Aug. 15, 2008

(87) PCT Pub. No.: WO2005/061744

PCT Pub. Date: Jul. 7, 2005

(65) Prior Publication Data

US 2008/0295922 A1 Dec. 4, 2008

(51) Int. Cl.
*C22C 21/06* (2006.01)
*C22F 1/047* (2006.01)

(52) U.S. Cl.
USPC ..... 148/440; 148/551; 420/543; 420/544; 420/553

(58) Field of Classification Search
USPC ..... 148/439, 440, 551; 420/543, 544, 420/553
See application file for complete search history.

(56) References Cited

U.S. PATENT DOCUMENTS

| | | | | |
|---|---|---|---|---|
| 6,369,347 | B1 | 4/2002 | Zhao et al. | |
| 6,544,358 | B1 * | 4/2003 | Carr et al. | 148/440 |

FOREIGN PATENT DOCUMENTS

| | | | |
|---|---|---|---|
| EP | 690142 | | 11/1995 |
| JP | 5005149 | | 1/1993 |
| JP | 05005149 | A * | 1/1993 |
| JP | 7310136 | | 11/1995 |
| JP | 07310136 | A * | 11/1995 |
| JP | 8165538 | | 6/1996 |
| JP | 11012676 | | 1/1999 |
| JP | 2004-976155 | | 3/2004 |

OTHER PUBLICATIONS

Azari, H.N. et al, Metallurgical and Materials Transactions A. 'Effect of Thermomechanical Treatment on the Evolution of Rolling and Recrystallization Textrues in Twin-Belt Cast AA5754 Aluminum Alloy', Jun. 2004, p. 1839-1851.*

* cited by examiner

*Primary Examiner* — Roy King
*Assistant Examiner* — Janelle Morillo
(74) *Attorney, Agent, or Firm* — McKenna, Long & Aldridge, LLP

(57) ABSTRACT

An aluminum-magnesium alloy sheet having a high strength prior to baking treatment, and having a high bake softening resistance. Contains, as a percentage of mass, 2-5% magnesium, more than 0.05% and 1.5% or less iron, 0.05-1.5% manganese, and crystal grain refiner, the remainder comprising aluminum and inevitable impurities, and among the inevitable impurities, less than 0.20% silicon being contained, the total amount of iron and manganese being greater than 0.3%, the amount of iron dissolved in solid solution being 50 ppm or greater, 5000 or more intermetallic compounds with a circle-equivalent diameter of 1-6 μm existing per square millimeter, and the average diameter of the recrystallized grains being 20 μm or smaller.

8 Claims, No Drawings

ALUMINUM ALLOY SHEET EXCELLENT IN RESISTANCE TO SOFTENING BY BAKING

This application claims the benefit of International Application No. PCT/JP2003/16442, filed on Dec. 19, 2003, which is hereby incorporated by reference as if fully set forth herein.

TECHNICAL AREA

The present invention concerns an aluminum alloy sheet whereon baking treatment is performed, for example, after painting, and high strength is sought for the material after the baking treatment, such as structural materials such as outer panels for household electric products and automobiles.

BACKGROUND ART

Due to the fact that aluminum-magnesium alloys have excellent formability, various types have been proposed in the abovementioned technical area, and have been used in prototypes and other products.

For example, JP-A H07-278716 discloses an aluminum alloy sheet for forming, having excellent local elongation, obtained by adding silicon and iron, the allowable amounts thereof being fairly high, to an aluminum-magnesium alloy containing a specific amount of magnesium, and during casting, making the thickness of the casting slabs thin, regulating the solidification rate of the molten alloy, and restricting the size of the intermetallic compounds.

However, in the abovementioned technical area, in recent years, an increasingly high strength is being sought for materials after baking treatment, and an aluminum-magnesium alloy is being sought which has high strength prior to baking treatment, and in addition, has very little decrease in strength after baking treatment is performed, that is, its bake softening ratio is low.

DISCLOSURE OF THE INVENTION

The objective of the present invention is to provide an aluminum-magnesium alloy sheet whereof the strength prior to baking treatment is high, and in addition the bake softening resistance is high, that is, the bake softening ratio is low.

The inventors of the present invention completed the present invention by discovering that by making the amount of iron dissolved in solid solution within the aluminum-magnesium alloy sheet high, and in addition, making the recrystallized grain size small, the strength prior to baking treatment becomes high, while bake softening resistance becomes excellent.

That is, the present invention provides an aluminum alloy sheet having excellent bake softening resistance, characterized by containing, as a percentage of weight, 2-5% magnesium, over 0.05% and 1.5% or less iron, 0.05-1.5% manganese, and crystal grain refiner, the remainder comprising aluminum and inevitable impurities, and among the inevitable impurities, the amount of silicon being less than 0.20%, the total amount of iron and manganese being greater than 0.3%, the amount of iron dissolved in solid solution being 50 ppm or greater, 5000 or more intermetallic compounds with a circle-equivalent diameter of 1-6 μm existing per square millimeter, and in addition, the average recrystallized grain diameter being 20 μm or below.

By making the amount of iron dissolved in solid solution high and refining the recrystallized grain size in this way, an aluminum alloy sheet having high strength and excellent bake softening resistance can be made.

In the present invention, in addition to the abovementioned composition, over 0.05% and up to 0.5% copper may be contained. By including copper, the strength and bake softening resistance is improved further.

BEST MODE FOR EMBODYING THE INVENTION

The reasons for restricting the composition of the aluminum alloy sheet of the present invention shall be explained. The units for the content of each of the components represented by "%" is weight percentage, if not specially noted.

[Magnesium: 2-5%]

Magnesium is added in order to improve strength and to impart formability, and if the content thereof is less than the lower bound value of 2%, the abovementioned effect will be small. If the upper bound value is exceeded, a region will be entered wherein stress corrosion cracking is easily generated, and in order to prevent this, special treatment is needed, so this is undesirable. The magnesium content is preferably 4.5% or less.

[Iron: Greater than 0.05% and 1.5% or Less; Manganese: 0.05-1.5%; Total Amount of Iron and Manganese: Greater than 0.3%]

Iron is effective in increasing bake softening resistance by suppressing the realignment of dislocations by increasing the amount of iron in solid solution. Further, due to the coexistence of both iron and manganese, the precipitation of many intermetallic compounds, for example, aluminum-iron and aluminum-iron-manganese compounds is promoted, so the number of recrystallization nucleation sites is increased, and the size of recrystallized grains is made smaller. The abovementioned effects will be small if the iron content is 0.05% or less, or the manganese content is less than 0.05%. On the other hand, if either the iron content or the manganese content exceeds the upper bound value of 1.5%, coarse intermetallic compounds are generated, and formability becomes inferior, so this is not desirable.

In order to precipitate the size and number of intermetallic compounds prescribed in the present invention, iron and manganese must coexist. In order to obtain this coexistence effect, the total content Fe+Mn of iron and manganese must be greater than 0.3%. The total content of iron and manganese is preferably 0.35% or greater, and more preferably 0.4% or greater. Additionally, from the perspective explained in the reasons for restriction of the individual upper bound values of the iron content and the manganese content, it is preferable for the total iron and manganese content to be less than 2%.

[Copper: Exceeding 0.05%, 0.5% or Less]

Copper is added in order to further improve strength and bake softening resistance. If the copper content is 0.05% or less, the abovementioned effect is small, and if the upper bound value of 0.5% is exceeded, corrosion-resistance is deteriorated.

[Crystal Grain Refiner]

Crystal grain refiner is added in order to prevent the generation of casting cracks due to rapid cooling during solidification of the molten alloy. Zirconium, titanium, and boron are typical elements used as crystal grain refiners. Either one of 0.001-0.2% zirconium or 0.001-0.3% titanium may be added alone, or both may be added in combination. 0.0001-0.1% boron may be added alone, but it may also be added in combination with zirconium or titanium. In particular, when added in combination with titanium, the effects will be synergistic. It is preferable that the total content of crystal grain refiner be 0.001-0.3%.

[Inevitable Impurities]

Inevitable impurities are mixed in from the aluminum ingots, return scrap, melting jigs and the like, and silicon, chromium, nickel, zinc, gallium, and vanadium are typical elements.

In particular, large amounts of silicon are mixed in from return scrap, so caution is needed during blending. If an excessive amount is contained, Mg2Si precipitates, and formability becomes inferior. Therefore, the upper limit on its content should be restricted to less than 0.2%. Preferably, this should be less than 0.15%.

Chromium is added in order to prevent stress corrosion cracking of aluminum-magnesium alloys, and although it is easily mixed in from return scrap, in the present invention, it is allowable as long as less than 0.3% is contained.

It is preferable for the nickel content to be less than 0.2%, and the gallium content and vanadium content to be less than 0.1% each.

The total content of inevitable impurities other than those mentioned above should be restricted to less than 0.3%, particularly from the viewpoint of keeping high formability.

[Amount of Iron Dissolved in Solid Solution: 50 ppm or Greater]

The reason for making the amount of iron dissolved in solid solution high is in order to increase strength and bake softening resistance. By increasing the amount of iron dissolved in solid solution, the strength after rolling treatment improves, and the realignment of dislocations in baking treatment is restricted, so the degree of softening is reduced. A preferable amount of iron dissolved in solid solution is 60 ppm or greater, with 70 ppm or greater being more preferable.

[Number of Intermetallic Compounds with a Circle-Equivalent Diameter of 1-6 μm is 5000 per Square Millimeter or Greater]

Intermetallic compounds with a circle-equivalent diameter of 1-6 μm can become nucleation sites for recrystallized grains, and contribute to the refining of recrystallized grains. Intermetallic compounds with a diameter of less than 1 μm cannot become nucleation sites for recrystallized grains. Additionally, if the number of intermetallic compounds with a diameter of 1-6 μm is less than 5000 per square millimeter, refined recrystallized grains according to the present invention cannot be obtained. It is preferable for the number to be 6000 per square millimeter or greater.

[Average Diameter of Recrystallized Grains being 20 μm or Smaller]

The refining of recrystallized grains after final annealing is for improving the strength of a sheet in comparison with a sheet having an aggregate of coarse crystal grains. If the average recrystallized grain diameter exceeds the upper limit, the improvement in strength is low so this is not desirable. It is preferable for the average recrystallized grain diameter to be 15 μm or smaller, and more preferable for this to be 10 μm or smaller.

Next, the preferred manufacturing method shall be explained. However, it is not necessary to be restricted to this method.

During the melting of the aluminum alloy in the present invention, after the composition of the molten alloy is adjusted, it is degassed and settled, fine adjustment of the composition is done as necessary, crystal grain refiner is added into the furnace or trough, and casting is then done.

The casting method is not particularly restricted. Any of casting with book mold, DC casting with thinner gauge, twin roll casting, belt casting, 3C method, or block casting method may be used.

During casting, the cooling rate of the molten alloy is put in the range of 40-90 degrees Celsius per second at ¼ of the thickness of the slab, so that a large number of minute intermetallic compounds are formed. If the cooling rate is less than 40 degrees Celsius per second for a molten alloy within the range of the composition of the present invention, the size of the particles becomes large, and the density of compounds with a circle-equivalent diameter of 1-6 μm becomes less than 5000 per square millimeter, and if the cooling rate is over 90 degrees Celsius, the size of the compounds becomes small, and the density of compounds with a circle-equivalent diameter of 1-6 μm becomes less than 5000 per square millimeter. The average diameter of intermetallic compounds is 2-3 μm.

Hot rolling is performed on the obtained sheet slabs if desired, and cold rolling is done to make a sheet of the desired thickness, and final annealing is done on this in order for recrystallization to occur. Annealing may be done before or between cold rolling, but the rolled sheet on which final annealing is done should have a cold rolling reduction of 85% or greater. Final annealing is done by continuous annealing (CAL) or batch annealing. Continuous annealing involves continuously annealing a coil while winding it up, and the heating rate of the sheet is set to 5 degrees Celsius per second or greater, and recrystallization is done by maintaining for about 1 second to 10 minutes in a temperature of 400-520 degrees Celsius. In batch annealing, a coil is treated within an annealing furnace, and the heating rate of the sheet is about 40 degrees Celsius per hour, and recrystallization is done by maintaining for about 10 minutes to 5 hours in a temperature of 300-400 degrees Celsius. Due to the combination of the size and number of the aforementioned intermetallic compounds, and the cold rolling reduction prior to final annealing, the average recrystallized grain diameter of the sheet becomes 20 μm or smaller. Such a sheet is then provided for practical use as is, or is put through a skin pass or a leveler with a cold rolling reduction of about 0.5-5%, in order to obtain flatness.

Embodiment 1

After degassing and settling molten alloys with the compositions described in Table 1, the slab was cast by the DC casting method with thin gauge. After scalping, cold rolling was done on the slab, to make a sheet of thickness 1 mm. Next, the sheet was continuously annealed (CAL). The size of intermetallic compounds, their number, the average recrystallized grain diameter, amount of iron dissolved in solid solution, 0.2% yield strength (YS), tensile strength (UTS), and elongation (EL) were measured. Next, tensile prestrain of 5% was given on the aforementioned sheet after annealing, and the 0.2% yield strength was measured. Next, heat treatment was performed on the prestrained sheet to simulate baking treatment at 180 degrees Celsius for 30 minutes, and 0.2% yield strength was measured after cooling. The abovementioned processes and measurement results are shown in Table 2 and Table 3.

Next, as comparative examples, the aforementioned alloys were cast by the DC casting method, but with the cooling rate changed. The obtained slabs were rolled, and heat treatment was done to simulate baking treatment. The procedures and measurement results are shown along with the embodiments in Table 2 and Table 3.

TABLE 1

| Alloy Composition (Units: mass %) | | | | | | | | | | |
|---|---|---|---|---|---|---|---|---|---|---|
| Alloy | Mg | Fe | Mn | Cu | Si | Zr | Ti | B | Fe + Mn | Note |
| A | 3.2 | 0.20 | 0.30 | 0.00 | 0.08 | 0.00 | 0.01 | 0.002 | 0.50 | Invention Example |
| B | 3.4 | 0.20 | 0.25 | 0.25 | 0.08 | 0.00 | 0.01 | 0.002 | 0.45 | Invention Example |
| C | 4.5 | 0.41 | 0.36 | 0.03 | 0.12 | 0.00 | 0.02 | 0.005 | 0.77 | Invention Example |
| D | 3.3 | 0.20 | 1.25 | 0.00 | 0.08 | 0.05 | 0.00 | 0.003 | 1.45 | Invention Example |
| E | 3.3 | 1.25 | 0.10 | 0.00 | 0.09 | 0.05 | 0.01 | 0.004 | 1.35 | Invention Example |

Note:
Remainder is aluminum and inevitable impurities

TABLE 2

| Manufacturing Processes | | | | | | | | | |
|---|---|---|---|---|---|---|---|---|---|
| Sample | Alloy | Casting Method/Slab Thickness (mm) | Cooling Rate (° C./sec) | Scalping/ Homogenization Treatment | Hot Rolling | Intermediate Annealing | Cold Rolling/*1 | Final Annealing | Note |
| 1 | A | DC Cast/40 mm | 79 | 15 mm/No | No | No | 1 mm/90 | 450° C. CAL | Invention Example |
| 2 | B | DC Cast/40 mm | 79 | 15 mm/No | No | No | 1 mm/90 | 450° C. CAL | Invention Example |
| 3 | A | DC Cast/50 mm | 75 | 20 mm/No | No | No | 1 mm/90 | 450° C. CAL | Invention Example |
| 4 | C | DC Cast/50 mm | 75 | 20 mm/No | No | No | 1 mm/90 | 450° C. CAL | Invention Example |
| 5 | D | DC Cast/40 mm | 79 | 15 mm/No | No | No | 1 mm/90 | 450° C. CAL | Invention Example |
| 6 | E | DC Cast/40 mm | 79 | 15 mm/No | No | No | 1 mm/90 | 450° C. CAL | Invention Example |
| 7 | A | DC Cast/508 mm | 5 | 5 mm/500° C. × 5 h | 6 mm | No | 1 mm/83 | 450° C. CAL | Comp. Example |
| 8 | C | DC Cast/65 mm | 20 | 30 mm/No | No | 2 mm/360° C. × 2 h | 1 mm/50 | 450° C. CAL | Comp. Example |
| 9 | A | DC Cast/40 mm | 79 | 15 mm/No | No | 2 mm/360° C. × 2 h | 1 mm/50 | 450° C. CAL | Comp. Example |

Note:
Cooling Rate is Measured at ¼ Thickness of Slab
Note:
*1 Cold Rolling Reduction (%)

TABLE 3

| Microstructures and Properties | | | | | | | | |
|---|---|---|---|---|---|---|---|---|
| Sample No. | Density (No./mm$^2$) of Intermetallic Compounds (1-6 μm Circle Equiv. Diameter) | Diameter of Recrystallized Grains (μm) | Amount of Iron Dissolved in Solid Solution (ppm) | 0.2% YS (MPa) | UTS (MPa) | EL (%) | 0.2% YS (MPa) and Softening Ratio (%) after 5% prestraining and heat treatment * | Note |
| 1 | 6800 | 8 | 79 | 122 | 238 | 29 | 189/156 (17.5) | Invention Example |
| 2 | 7175 | 9 | 76 | 117 | 253 | 27 | 192/176 (8.3) | Invention Example |
| 3 | 6408 | 10 | 78 | 120 | 236 | 28 | 187/154 (17.6) | Invention Example |
| 4 | 10352 | 8 | 81 | 165 | 312 | 28 | 235/205 (12.8) | Invention Example |
| 5 | 13120 | 6 | 70 | 145 | 268 | 25 | 212/198 (6.6) | Invention Example |

TABLE 3-continued

| Microstructures and Properties | | | | | | | | |
|---|---|---|---|---|---|---|---|---|
| Sample No. | Density (No./mm$^2$) of Intermetallic Compounds (1-6 μm Circle Equiv. Diameter) | Diameter of Recrystallized Grains (μm) | Amount of Iron Dissolved in Solid Solution (ppm) | 0.2% YS (MPa) | UTS (MPa) | EL (%) | 0.2% YS (MPa) and Softening Ratio (%) after 5% prestraining and heat treatment * | Note |
| 6 | 17250 | 5 | 101 | 138 | 259 | 25 | 205/182 (11.2) | Invention Example |
| 7 | 3080 | 25 | 5 | 105 | 224 | 29 | 173/123 (28.9) | Comp. Example |
| 8 | 4859 | 22 | 45 | 140 | 282 | 31 | 212/165 (22.2) | Comp. Example |
| 9 | 6812 | 25 | 48 | 105 | 224 | 29 | 172/137 (20.3) | Comp. Example |

Note:
The diameter and density of intermetallic compounds were measured by image analysis.
The recrystallized grain size was measured by the intercept method.
The amount of iron dissolved in solid solution was measured by the heat phenol method.
* The values in each of the boxes: A/B (C) indicate the following. A, B represent the 0.2% YS before and after heat treatment respectively, and C represents softening ratio.

From the results shown in tables 1-3, sample numbers 1, 2, 3, 4, 5, and 6 according to the present invention, since they have a high density of intermetallic compounds, have a small average diameter for recrystallized grains, their 0.2% yield strength is high, and the amount of iron dissolved in solid solution is high, so it can be seen that the bake softening ratio is low. On the other hand, for samples 7 and 8 according to the comparative examples, since the density of intermetallic compounds is low, the diameter of recrystallized grains is large, the 0.2% yield strength is low, and the amount of iron dissolved in solid solution is low, so it can be seen that the softening ratio is high. Sample 9 of the comparative examples has a low cold rolling reduction prior to final annealing, so the average diameter of the recrystallized grains is large, the 0.2% yield strength is low, and the amount of iron in solid solution is low, so that the softening ratio is high.

Embodiment 2

After molten alloys with the compositions listed in Table 4 were degassed and settled, slabs of thickness 7 mm were cast by the twin belt casting method at a cooling rate for the molten alloy of 75 degrees C. per second. These slabs were cold rolled and made into sheets of thickness 1 mm (cold rolling reduction 86%). Next, these sheets were continuously annealed (CAL). The size of intermetallic compounds, their number, the average recrystallized grain diameter, amount of iron dissolved in solid solution, 0.2% yield strength (0.2 YS), tensile strength (UTS), and elongation (EL) were measured. Next, tensile prestrain of 5% was given on the aforementioned sheets after annealing, and the 0.2% yield strength was measured. Next, heat treatment was performed on the prestrained sheets to simulate baking treatment at 180 degrees Celsius for 30 minutes, and 0.2% yield strength was measured after cooling. The abovementioned processes and measurement results are shown in Table 5 and Table 6.

Next, as comparative examples, slabs of thickness 38 mm were cast from the aforementioned molten alloys at a cooling rate of 30 degrees Celsius per second. Further, 7 mm slabs were also cast by the twin rolling method (cooling rate 300 degrees Celsius per second). The processes and measurement results are shown along with those for the embodiments.

TABLE 4

| Alloy Composition (Units: mass %) | | | | | | | | | | |
|---|---|---|---|---|---|---|---|---|---|---|
| Alloy | Mg | Fe | Mn | Cu | Si | Zr | Ti | B | Fe + Mn | Note |
| A | 3.3 | 0.20 | 0.22 | 0.00 | 0.08 | 0.00 | 0.01 | 0.002 | 0.42 | Invention Example |
| B | 3.4 | 0.20 | 0.20 | 0.25 | 0.08 | 0.00 | 0.01 | 0.002 | 0.40 | Invention Example |
| C | 4.5 | 0.20 | 0.35 | 0.03 | 0.10 | 0.00 | 0.02 | 0.005 | 0.55 | Invention Example |
| D | 3.0 | 0.20 | 1.30 | 0.03 | 0.10 | 0.06 | 0.00 | 0.002 | 1.50 | Invention Example |
| E | 3.0 | 1.20 | 0.10 | 0.03 | 0.10 | 0.06 | 0.01 | 0.005 | 1.30 | Invention Example |

Note:
Remainder is aluminum and inevitable impurities

TABLE 5

| Manufacturing Processes | | | | | | | | | |
|---|---|---|---|---|---|---|---|---|---|
| Sample | Alloy | Slab Thickness (mm) | Cooling Rate (° C./sec) | Scalping/ Homogenization Treatment | Hot Rolling | Intermediate Annealing | Cold Rolling/*1 | Final Annealing | Note |
| 1 | A | 7 mm | 75 | No | No | No | 1 mm/86 | 430° C. CAL | Invention Example |
| 2 | B | 7 mm | 75 | No | No | No | 1 mm/86 | 430° C. CAL | Invention Example |
| 3 | C | 7 mm | 75 | No | No | No | 1 mm/86 | 450° C. CAL | Invention Example |
| 4 | D | 7 mm | 75 | No | No | No | 1 mm/86 | 450° C. CAL | Invention Example |
| 5 | E | 7 mm | 75 | No | No | No | 1 mm/86 | 450° C. CAL | Invention Example |
| 6 | A | 38 mm | 30 | No | 7 mm | No | 1 mm/86 | 450° C. CAL | Comp. Example |
| 7 | A | 7 mm | 300 | No | No | No | 1 mm/86 | 430° C. CAL | Comp. Example |
| 8 | A | 7 mm | 75 | No | No | 2 mm/360° C. × 2 h | 1 mm/50 | 430° C. CAL | Comp. Example |

Note:
Cooling Rate is Measured at 1/4 Thickness of Slab
Note:
*1 Cold Rolling Reduction (%)

TABLE 6

| Microstructures and Properties | | | | | | | | |
|---|---|---|---|---|---|---|---|---|
| Sample No. | Density (No./mm$^2$) of Intermetallic Compounds (1-6 μm Circle Equiv. Diameter) | Diameter of Recrystallized Grains (μm) | Amount of Iron Dissolved in Solid Solution (ppm) | 0.2% YS (MPa) | UTS (MPa) | EL (%) | 0.2% YS (MPa) and Softening Ratio (%) after 5% prestraining and heat treatment * | Note |
| 1 | 6435 | 9 | 76 | 118 | 235 | 27 | 185/152 (17.8) | Invention Example |
| 2 | 6813 | 8 | 74 | 116 | 250 | 28 | 190/171 (10.0) | Invention Example |
| 3 | 9274 | 7 | 80 | 154 | 297 | 27 | 232/201 (13.4) | Invention Example |
| 4 | 13052 | 6 | 70 | 141 | 265 | 25 | 207/192 (7.2) | Invention Example |
| 5 | 17183 | 5 | 101 | 134 | 257 | 25 | 201/183 (9.0) | Invention Example |
| 6 | 4910 | 25 | 42 | 106 | 224 | 26 | 173/132 (23.7) | Comp. Example |
| 7 | 1900 | 50 | 90 | 98 | 220 | 25 | 165/140 (15.2) | Comp. Example |
| 8 | 6854 | 24 | 45 | 107 | 225 | 27 | 175/135 (22.9) | Comp. Example |

Note:
The diameter and density of intermetallic compounds were measured by image analysis.
The recrystallized grain size was measured by the intercept method.
The amount of iron dissolved in solid solution was measured by the heat phenol method.

From the results shown in Tables 4-6, in samples number 1-5 according to the present invention, since the density of intermetallic compounds is high, the diameter of recrystallized grains is small, the 0.2% yield strength is high, and the amount of iron dissolved in solid solution is high, so it can be seen that the bake softening ratio is low. On the other hand, sample number 6 according to the comparative examples has a low density of intermetallic compounds, so the diameter of recrystallized grains is large, the 0.2% yield strength is low, and the amount of iron dissolved in solid solution is low, so it can be seen that the softening ratio is high. Sample number 7 according to the comparative examples has a low density of intermetallic compounds, so the diameter of recrystallized grains is large, and it can be seen that the 0.2% yield strength is low. Sample number 8 according to the comparative examples has a cold rolling reduction ratio prior to final annealing of less than 85%, so the diameter of recrystallized grains is large, the 0.2% yield strength is low, and the amount of iron dissolved in solid solution is low, so the softening ratio is high.

As stated above, the aluminum alloy sheet according to the present invention has excellent bake softening resistance, so that even if, after forming, painting and the like is performed, and baking treatment is done on the paint, the degree of softening is low, and this can be widely used for applications such as, for example, automobile body sheets, so their industrial value is extremely high.

The invention claimed is:

1. An aluminum alloy sheet having excellent bake softening resistance and having a recrystallized grain structure, characterized by containing, as a percentage of mass, 2-5% magnesium, over 0.05% and 1.5% or less iron, 0.05-1.5% manganese, and crystal grain refiner, the remainder comprising aluminum and inevitable impurities, and among the inevitable impurities, the amount of silicon being less than 0.15%, the total amount of iron and manganese being greater than 0.4%, the amount of iron dissolved in solid solution being 70 ppm or greater, 5000 or more intermetallic compounds with a circle-equivalent diameter of 1-6 μm existing per square millimeter, and in addition, the average recrystallized grain diameter being 20 μm or below.

2. An aluminum alloy sheet having excellent bake softening resistance and having a recrystallized grain structure recited in claim 1, characterized by having a copper content of over 0.05% and 0.5% or less.

3. An aluminum alloy sheet having excellent bake softening resistance and having a recrystallized grain structure recited in claim 1, characterized by containing the combination of 0.001-0.3% titanium and 0.0001-0.1% boron as a crystal grain refiner.

4. An aluminum alloy sheet having excellent bake softening resistance and having a recrystallized grain structure recited in claim 2, characterized by containing the combination of 0.001-0.3% titanium and 0.0001-0.1% boron as a crystal grain refiner.

5. An aluminum alloy sheet having excellent bake softening resistance and having a recrystallized grain structure recited in claim 1, characterized by the total amount of iron and manganese being greater than 0.77%.

6. An aluminum alloy sheet having excellent bake softening resistance and having a recrystallized grain structure recited in claim 2, characterized by the total amount of iron and manganese being greater than 0.77%.

7. A manufacturing method of an aluminum alloy sheet having excellent bake softening resistance and having a recrystallized grain structure recited in claim 1, comprising the steps of:

casting a molten aluminum alloy containing said alloy composition of claim 1 into a slab at the cooling rate of 40-90 degrees Celsius per second at ¼ of the thickness of said slab, and subsequently, cold-rolling said slab to a sheet of a final gauge without inter-annealing at a cold reduction of 85% or greater, and continuously annealing by heating a sheet at the heating rate of 5 degrees Celsius per second or greater, holding for 1 second to 10 minutes in a temperature of 400-520 degrees Celsius.

8. A manufacturing method of an aluminum alloy sheet having excellent bake softening resistance and having a recrystallized grain structure recited in claim 2, comprising the steps of:

casting a molten aluminum alloy containing said alloy composition of claim 2 into a slab at the cooling rate of 40-90 degrees Celsius per second at ¼ of the thickness of said slab, and subsequently, cold-rolling said slab to a sheet of a final gauge without inter-annealing at a cold reduction of 85% or greater, and continuously annealing by heating a sheet at the heating rate of 5 degrees Celsius per second or greater, holding for 1 second to 10 minutes in a temperature of 400-520 degrees Celsius.

* * * * *

UNITED STATES PATENT AND TRADEMARK OFFICE

CERTIFICATE OF CORRECTION

PATENT NO. : 8,524,015 B2
APPLICATION NO. : 10/572202
DATED : September 3, 2013
INVENTOR(S) : Zhao et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1150 days.

Signed and Sealed this
Fifteenth Day of September, 2015

Michelle K. Lee

Michelle K. Lee
*Director of the United States Patent and Trademark Office*